US006358027B1

(12) United States Patent
Lane

(10) Patent No.: US 6,358,027 B1
(45) Date of Patent: Mar. 19, 2002

(54) ADJUSTABLE FIT PROGRESSIVE CAVITY PUMP/MOTOR APPARATUS AND METHOD

(75) Inventor: William Lane, Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/602,514

(22) Filed: Jun. 23, 2000

(51) Int. Cl.[7] ..... F04C 2/107; F04C 5/00; F04C 15/04

(52) U.S. Cl. ..... 418/1; 418/2; 418/48; 418/107

(58) Field of Search ..... 418/1, 48, 107, 418/21, 28, 2

(56) References Cited

U.S. PATENT DOCUMENTS

| | | | | | |
|---|---|---|---|---|---|
| 2,085,115 | A | * | 6/1937 | Moineau | 418/48 |
| 2,612,845 | A | | 10/1952 | Byram et al. | 418/48 |
| 2,733,854 | A | * | 2/1956 | Chang | 418/48 |
| 2,957,427 | A | * | 10/1960 | O'Connor | 418/48 |
| 4,187,061 | A | | 2/1980 | Jurgens | 418/48 |
| 4,415,316 | A | | 11/1983 | Jurgens | 418/48 |
| 4,676,725 | A | | 6/1987 | Eppink | 418/48 |
| 5,120,204 | A | | 6/1992 | Mathewson et al. | 418/48 |
| 5,145,343 | A | | 9/1992 | Belcher | 418/48 |
| 5,171,138 | A | | 12/1992 | Forrest | 418/48 |
| 5,358,390 | A | | 10/1994 | Jager | 418/48 |
| 5,722,820 | A | | 3/1998 | Wild et al. | 418/48 |

FOREIGN PATENT DOCUMENTS

| | | | | |
|---|---|---|---|---|
| IT | 544242 | * | 7/1956 | 418/48 |
| RU | 375408 | * | 3/1973 | 418/48 |
| RU | 400689 | * | 10/1973 | 418/48 |
| RU | 412367 | * | 1/1974 | 418/48 |

* cited by examiner

*Primary Examiner*—John J. Vrablik
(74) *Attorney, Agent, or Firm*—Moser, Patterson & Sheridan, L.L.P.

(57) ABSTRACT

The present invention provides an adjustable rotor and/or stator, so that the interference fit and/or clearance can be adjusted. The rotor and/or stator are tapered to provide a difference in fit between the rotor and stator by longitudinal adjustment of their relative position. In one embodiment, the adjustment may occur while the PCP in mounted downhole in a wellbore. In another embodiment, the adjustment may occur automatically depending on sensor input of operating conditions of the PCP.

33 Claims, 14 Drawing Sheets

ADJUSTABLE FIT PROGRESSIVE CAVITY PUMP/MOTOR APPARATUS AND METHOD

BACKGROUND OF THE INVENTION

1. Field of the Invention

The present invention relates to the equipment and methods in oil field operations. Particularly, the invention relates to helical gear pumps.

2. Background of the Related Art

Helical gear pumps, typically known as progressive cavity pumps/motors (herein PCPs), are frequently used in oil field applications, for pumping fluids or driving downhole equipment in the wellbore. A typical PCP is designed according to the basics of a gear mechanism patented by Moineau in U.S. Pat. No. 1,892,217, incorporated by reference herein, and is generically known as a "Moineau" pump or motor. The mechanism has two helical gear members, where typically an inner gear member rotates within a stationary outer gear member. In some mechanisms, the outer gear member rotates while the inner gear member is stationary and in other mechanisms, the gear members counter rotate relative to each other. Typically, the outer gear member has one helical thread more than the inner gear member. The gear mechanism can operate as a pump for pumping fluids or as a motor through which fluids flow to rotate an inner gear so that torsional forces are produced on an output shaft. Therefore, the terms "pump" and "motor" will be used interchangeably herein.

FIG. 1 is a schematic cross sectional view of a pumping/power section of a PCP. FIG. 2 is a schematic cross sectional view of the PCP shown in FIG. 1. Similar elements are similarly numbered and the figures will be described in conjunction with each other. The pumping section 1 includes an outer stator 2 formed about an inner rotor 4. The stator 2 typically includes an outer shell 2*a* and an elastomeric member 10 formed therein. The rotor 4 includes a plurality of gear teeth 6 formed in a helical thread pattern around the circumference of the rotor. The stator 2 includes a plurality of gear teeth 8 for receiving the rotor gear teeth 6 and typically includes one more tooth for the stator than the number of gear teeth in the rotor. The rotor gear teeth 6 are produced with matching profiles and a similar helical thread pitch compared to the stator gear teeth 8 in the stator. Thus, the rotor 4 can be matched to and inserted within the stator 2. The rotor typically can have from one to nine teeth, although other numbers of teeth can be made.

Each rotor tooth forms a cavity with a corresponding portion of the stator tooth as the rotor rotates. The number of cavities, also known as stages, determines the amount of pressure that can be produced by the PCP. Typically, reduced or no clearance is allowed between the stator and rotor to reduce leakage and loss in pump efficiency and therefore the stator 2 typically includes the elastomeric member 10 in which the helical gear teeth 8 are formed. Alternatively, the elastomeric member 10 can be coupled to the rotor 4 and engage teeth formed on the stator 2 in similar fashion. The rotor 4 flexibly engages the elastomeric member 10 as the rotor turns within the stator 2 to effect a seal therebetween. The amount of flexible engagement is referred to as a compressive or interference fit.

FIG. 3 is a cross sectional schematic view of diameters of the stator shown in FIGS. 1 and 2. A typical stator 2 has a constant minor diameter 3*a* defined by a circle circumscribing an inner periphery of the stator teeth 8. The typical stator also has a constant major diameter 5*a* defined by a circle circumscribing an outer periphery of the teeth 8. A thread height 7*a* is the height of the teeth, which is the difference between the major diameter and the minor diameter divided by two, i.e., a minor radius subtracted from a major radius.

FIG. 4 is a cross sectional schematic view of diameters of the rotor shown in FIGS. 1 and 2. The rotor 4 has minor and major diameters and a thread height to correspond with the stator. The typical rotor has a minor diameter 3*b* defined by a circle circumscribing an inner periphery of the teeth 6. The rotor also has a major diameter Sb defined by a circle circumscribing an outer periphery of the teeth 6. The thread height 7*b* is the difference between the major diameter and the minor diameter divided by two.

A PCP used as a pump typically includes an input shaft 18 that is rotated at a remote location, such as a surface of a wellbore (not shown). The input shaft 18 is coupled to the rotor 4 and causes the rotor 4 to rotate within the stator 2, as well as precess around the circumference of the stator. Thus, at least one progressive cavity 16 is created that progresses along the length of the stator as the rotor is rotated therein. Fluid contained in the wellbore enters a first opening 12, progresses through the cavities, out a second opening 14 and is pumped through a conduit coupled to the PCP. Similarly, a PCP used as a motor allows fluid to flow from typically a tubing coupled to the PCP, such as coiled tubing, through the second opening 14, and into the PCP to create hydraulic pressure. The progressive cavity 16 created by the rotation moves the fluid toward the first opening 12 and is exhausted therethrough. The hydraulic pressure, causing the rotor 4 to rotate within the stator 2, provides output torque to an output shaft 19 used to rotate various tools attached to the motor.

The rubbing of the rotor in the stator as the rotor rotates causes several problems. Various operating conditions change the interference fit and therefore a predetermined amount of interference is difficult at best to obtain for efficient performance under the varying conditions. For example, the rubbing causes the elastomeric member to wear. The amount of interference is reduced and, therefore, the amount of pressure or output torque that the PCP can produce is also reduced. Further, the interference fit between the rotor and stator is especially prone to deterioration from particulates in a production fluid. Still further, the rubbing itself produces heat buildup in the elastomeric member and decreases the life of the elastomeric member. As another example, a PCP can encounter fluctuations in operating temperatures. For example, some wellbore operations inject steam downhole through the pump into a production zone and then reverse the flow to pump production fluids produced by the wellbore at a different temperature up the wellbore. The temperature fluctuations can cause the components, particularly the elastomeric member, to swell and change the interference fit between the stator and rotor. The swelling creates additional loads on the pump and to a corresponding input device, such as an electric motor used to rotate the shaft 18 and the rotor 4 of the PCP. Further, swelling can occur with time of use and with chemicals existing in production fluids. The swelling can be great enough to damage the pump and require repair or replacement.

Some proposed solutions by those in the art include preloading the elastomeric member, so that the elastomeric member compensates to maintain a given interference fit as wear occurs. Others have proposed an inflatable bladder type of elastomeric member than can be expanded to increase the interference fit. One solution offered by U.S. Pat. No. 5,722,820 seeks to equalize pressures across the several stages of the PCP, and thereby reduce the heat buildup. The amount of interference fit is gradually reduced in subsequent stages by gradually reducing either the rotor diameter or increasing the stator diameter. However, the reference does not address adjustments needed to solve the problems of swelling or deterioration or the varying operating conditions.

Therefore, there exists a need for providing a PCP that can be adjusted to a variety of selected interference fits or even clearances to meet various operating conditions.

SUMMARY

The present invention provides an adjustable rotor and/or stator, so that the interference fit and/or clearance can be adjusted. The rotor and/or stator are tapered to provide a difference in fit between the rotor and stator by manual or automatic longitudinal adjustment of their relative position. In one embodiment, the adjustment may occur while the PCP in mounted downhole in a wellbore. In another embodiment, the adjustment may occur automatically depending on sensor input of operating conditions of the PCP.

In one aspect, a progressive cavity pump (PCP) is provided, comprising a stator having a helical internal bore with at least two helical threads, the stator being tapered at least partially between the inlet and the outlet, a rotor having a helical periphery with one helical thread less than the stator and disposed at least partially within the stator to form a plurality of cavities between the rotor and the stator, the rotor being tapered at least partially between the inlet and the outlet.

In another aspect, a method of adjusting a progressive cavity pump is provided, comprising inserting a progressive cavity pump into a wellbore, the pump comprising a stator having a helical internal bore with at least two helical threads, the stator being tapered at least partially between the inlet and the outlet, a rotor having a helical periphery with one helical thread less than the stator and disposed at least partially within the stator to form a plurality of cavities between the rotor and the stator, the rotor being tapered at least partially between the inlet and the outlet, longitudinally positioning the rotor relative to the stator at a first longitudinal position and adjusting the rotor relative to the stator to a second longitudinal position.

In another aspect, a progressive cavity pump having a inlet and an outlet is provided, comprising a stator having a helical internal bore with at least two helical threads, the stator having a first helical pitch, a rotor having a helical periphery with one helical thread less than the stator and disposed at least partially within the stator to form a plurality of cavities between the rotor and the stator, the rotor having a second helical pitch different from the first helical pitch at least partially between the inlet and the outlet.

DETAILED DESCRIPTION OF A PREFERRED EMBODIMENT

Figure 5:
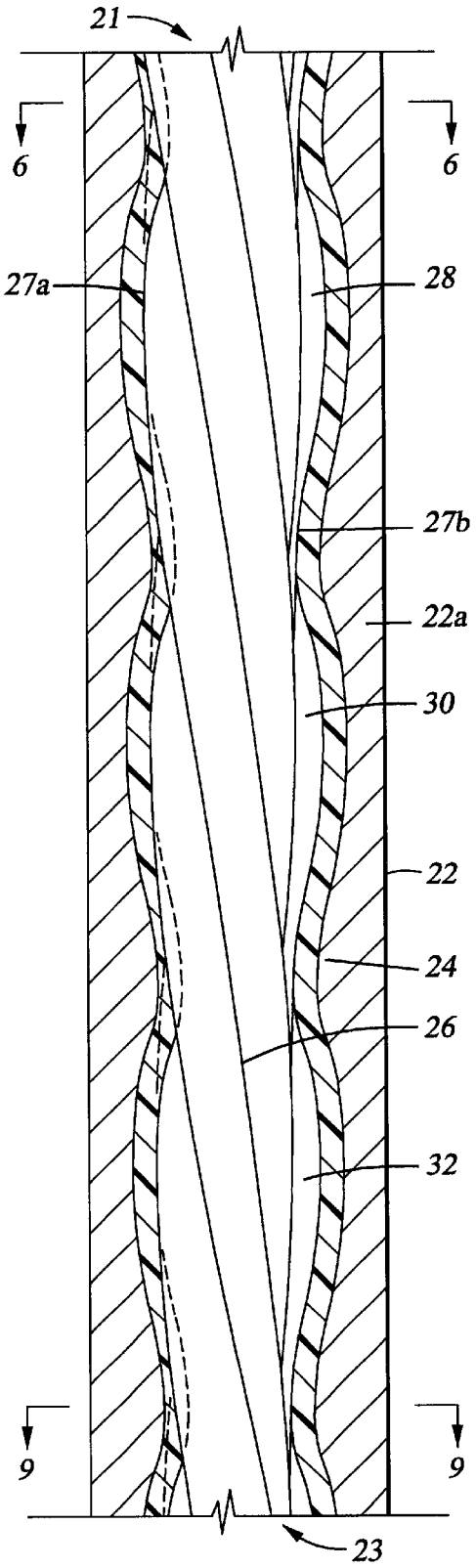
FIG. 5 is a schematic cross sectional view of a portion of a PCP having a tapered rotor.

FIG. 5 is a schematic cross sectional view of a portion of a PCP. The PCP 20 has a rotor and/or stator with a tapered cross section. In one embodiment, the rotor is tapered progressively smaller at a minor diameter of the rotor from a first portion 21 to a second portion 23 of the PCP 20. Similarly, the stator could be tapered progressively smaller from the first portion 21 to the second portion 23 to correspond to the rotor. Alternatively, the tapers can be progressively larger from the first portion to the second portion. Generally, in some embodiments, the fit/clearance between the rotor and the stator is relatively constant if the tapers on the rotor and stator are uniform. If other embodiments, the fit/clearance itself can be tapered if the tapers of the rotor and stator are nonuniform.

The PCP 20 includes a stator 22, having a shell 22*a* and a elastomeric member 24 generally coupled to the shell 22*a*, and a rotor 26 disposed therethrough. Generally, the shell 22*a* and the rotor are made of metallic material such as steel. For illustrative purposes, the stator 22 includes the elastomeric member 24. However, it is to be understood herein that the elastomeric member could be coupled to the rotor 26 and the stator shell formed with corresponding helical threads. Further, the PCP 20 may be formed without a separate elastomeric member, if, for example, the rotor and/or stator is formed with suitable materials or enough clearance is designed into the components. For example, the rotor and/or stator can be formed from composite materials, such as fiberglass, plastics, hydrocarbon-based materials and other structural materials, and may include strengthening members, such as fibers embedded in the material. Generally, the interface between the rotor and stator is flexible and yet retains structural integrity and resists abrasion. However, the interface can be substantially rigid if, for example, sufficient clearance is provided between the rotor and stator. Thus, statements herein regarding the interaction between the stator, the elastomeric member, and the rotor include any of the above combinations.

Figure 1:
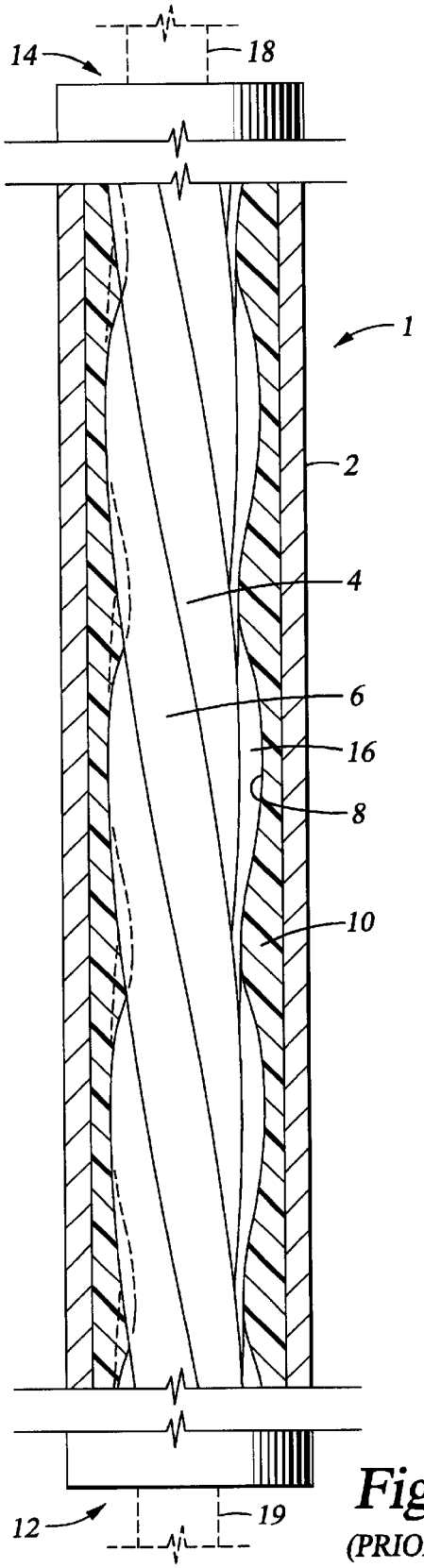
Fig. 1 (PRIOR ART)
FIG. 1 is a schematic cross sectional view of a pumping/motor section of a progressive cavity pump (PCP).
Figure 2:
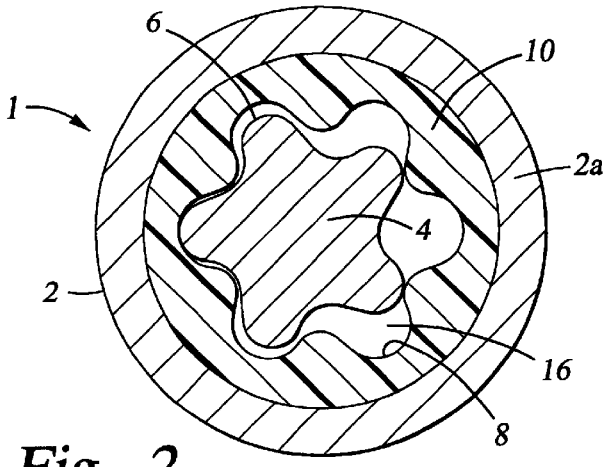
Fig. 2 (PRIOR ART)
FIG. 2 is a schematic cross sectional view of the pumping/power section of the PCP shown in FIG. 1.
Figure 3:
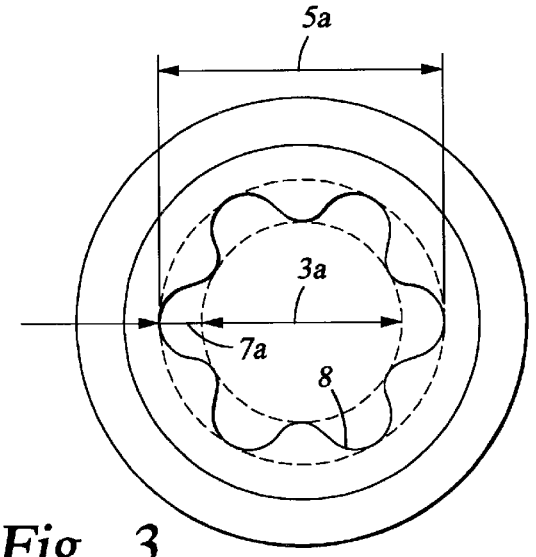
Fig. 3 (PRIOR ART)
FIG. 3 is a schematic cross sectional view of diameters of the stator shown in FIGS. 1 and 2.
Figure 4:
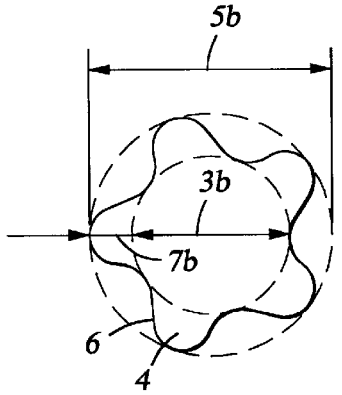
Fig. 4 (PRIOR ART)
FIG. 4 is a schematic cross sectional view of diameters of the rotor shown in FIGS. 1 and 2.

In one embodiment, the stator shell 22*a* is formed with threads and the elastomeric member 24 formed thereon. For example, the threads can be formed in the shell and the elastomeric member formed by coating the shell with elastomeric material, such as rubber, Buna-N, nitrile-based elastomers, fluoro-based elastomers, Teflon®, silicone, plastics, other elastomeric materials or combinations thereof. The elastomeric member could have a relatively constant thickness. Alternatively, the elastomeric member could be formed with a varying thickness, as shown in FIGS. 1–2, for any of the embodiments described herein.

The placement of the rotor 26 in the stator 22 creates a first cavity 28, a second cavity 30 and a third cavity 32. For the purposes of the example, three cavities are shown. However, it is to be understood that the number of cavities can vary depending on the number of stages desired in the PCP. Further, the cavities progress in position up and down the length of the PCP as the rotor 26 rotates within the stator 22. The contact of the rotor 26 with the elastomeric member 24 generally creates an interference fit, such as shown at portions 27*a* and 27*b*. The interference fit can vary depending on the operating conditions, as explained in reference to FIGS. 6–15.

Figure 6:
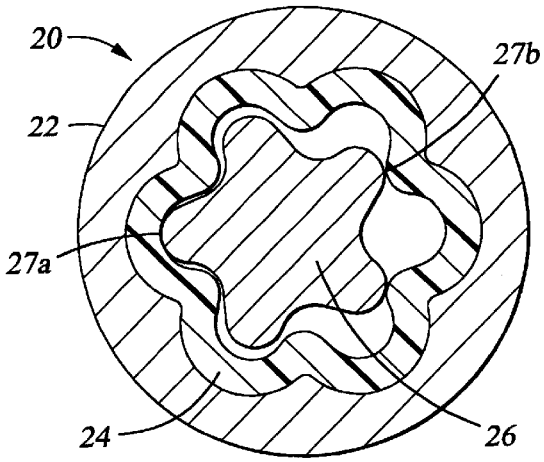
FIG. 6 is a schematic cross sectional view of the pumping/power section of the PCP shown in FIG. 5 at section 6.
Figure 7:
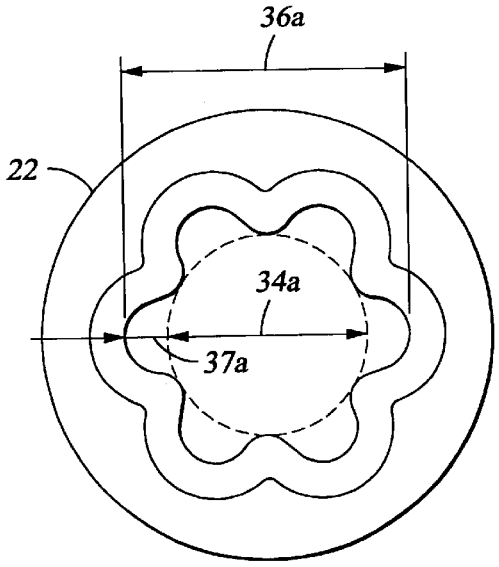
FIG. 7 is a schematic cross sectional view of diameters of the stator shown in FIG. 6.
Figure 8:
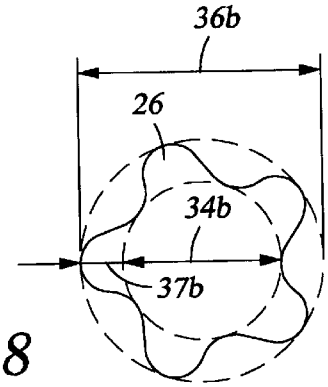
FIG. 8 is a schematic cross sectional view of diameters of the rotor shown in FIG. 6.

FIG. 6 is a schematic cross sectional view of the pumping/power section of the PCP shown in FIG. 5 at section 6. FIG. 7 is a schematic cross sectional view of diameters of the stator shown in FIG. 6. FIG. 8 is a schematic cross sectional view of diameters of the rotor shown in FIG. 6. FIGS. 6–8 will be described jointly and similar elements are similarly numbered. The rotor 26 is disposed within the stator 22. The elastomeric member 24 engages the rotor as the rotor rotates within the stator. For example, the rotor engages the elastomeric member at a portion 27*a* and a distal portion 27*b* and generally forms an interference fit with the stator through the elastomeric member. The stator has a minor diameter 34*a*, a major diameter 36*a* and a resulting thread height 37*a*, shown in FIG. 7. The rotor has a corresponding minor diameter 34*b*, a major diameter 36*b* and a resulting thread height 37*b*, shown in FIG. 8. The rotor and/or stator have a relatively constant thread height, i.e., the height of the threads are the same across the two or more of the stages of the PCP 20. Thus, as the rotor and/or stator diminish in cross sectional area, the teeth remain a constant height.

Figure 9:
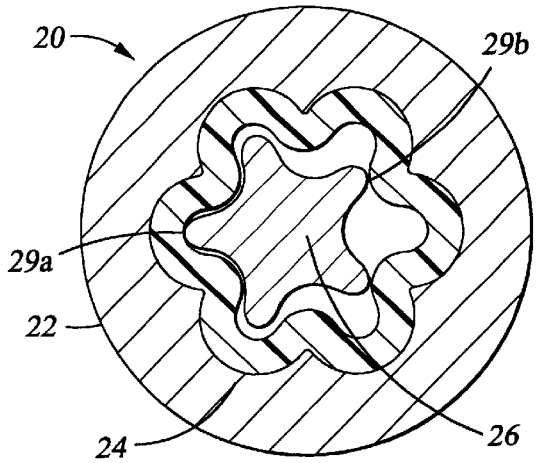
FIG. 9 is a schematic cross sectional view of the pumping/power section of the PCP shown in FIG. 5 at section 9.
Figure 10:
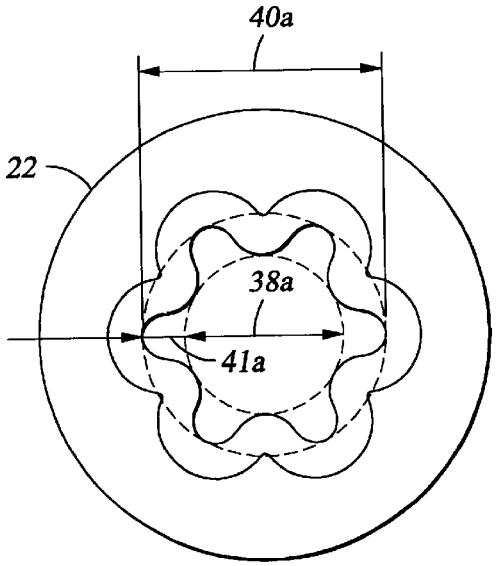
FIG. 10 is a schematic cross sectional view of diameters of the stator shown in FIG. 9.
Figure 11:
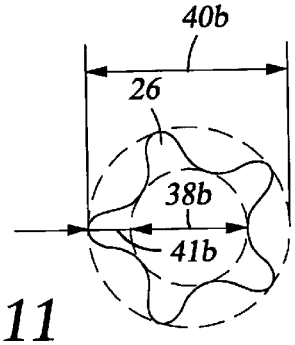
FIG. 11 is a schematic cross sectional view of diameters of the rotor shown in FIG. 9.

FIG. 9 is a schematic cross sectional view of the pumping/power section of the PCP shown in FIG. 5 at section 9. FIG. 10 is a schematic cross sectional view of diameters of the stator shown in FIG. 9. FIG. 11 is a schematic cross sectional view of diameters of the rotor shown in FIG. 9. FIGS. 9–11 will be described jointly and have similar elements similarly numbered. The stator has a minor diameter 38*a*, a major diameter 40*a* and a resulting thread height 41*a*, shown in FIG. 10. The rotor has a corresponding minor diameter 38*b*, a major diameter 40*b* and a resulting thread height 41*b*, shown in FIG. 11.

The rotor 26 is smaller in cross sectional area at section 9 than at section 6, shown in FIG. 5, and can form a progressive taper in at least a portion of the pumping section of the PCP 20. However, the elastomeric member 24 engages the rotor as the rotor rotates within the stator, because the stator is tapered correspondingly to the rotor. For example, the rotor engages the elastomeric member at a portion 29*a* and a distal portion 29*b* and generally forms an interference fit with the stator through the elastomeric member.

Figure 12:
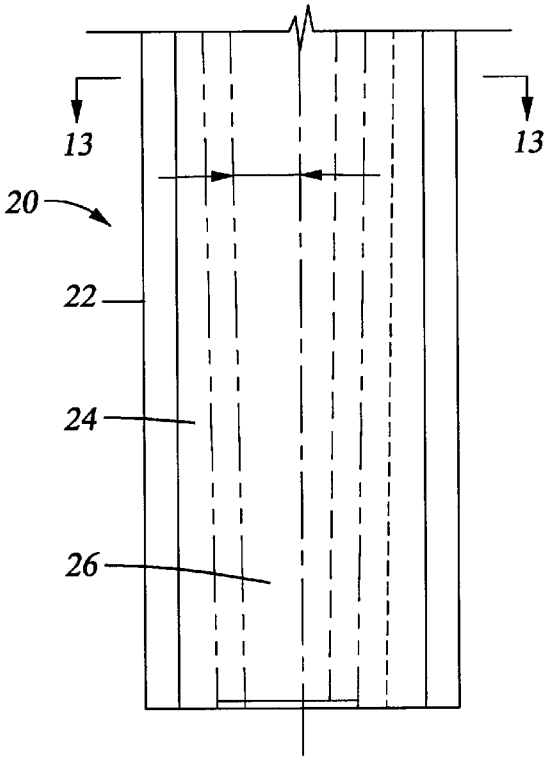
FIG. 12 is a schematic cross sectional view of a portion of a PCP having a tapered rotor in a first position.
Figure 13:
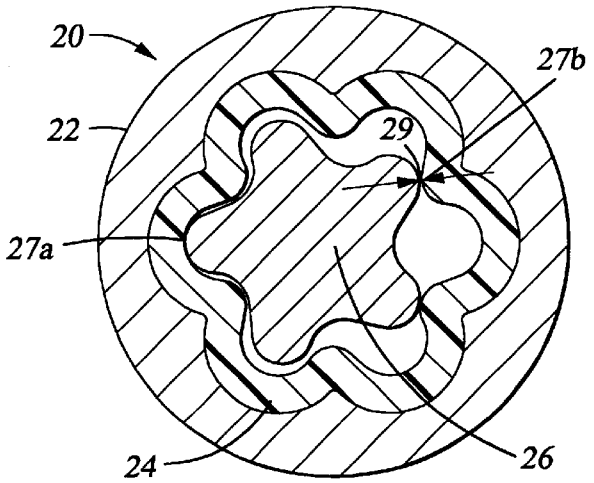
FIG. 13 is a schematic cross sectional view of t he pumping/power section of the PCP shown in FIG. 12 at section 13.

FIG. 12 is a schematic cross sectional view of a portion of the PCP 20 with the tapered rotor and/or stator in a first position. FIG. 13 is a schematic cross sectional view of the pumping/power section of the PCP shown in FIG. 12 at section 13. Similar elements are similarly numbered and the figures will be described jointly. When the rotor is engaged with the stator, the relative fit between the rotor and stator is in a first condition, so that, for example, normal pumping can occur. The first condition could be a predetermined operating condition for which the pump was designed without wear and swelling of the components. The rotor can contact the stator at, for example, portions 27*a* and 27*b*.

Figure 14:
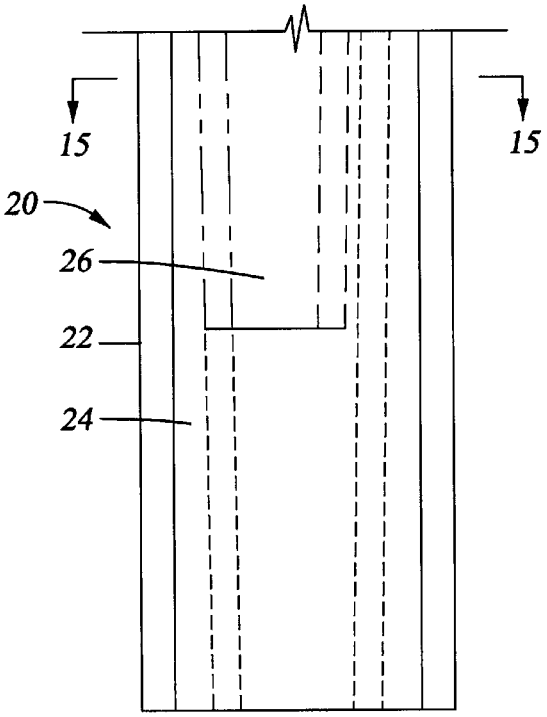
FIG. 14 is a schematic cross sectional view of a portion of a PCP having a tapered rotor in a second position.
Figure 15:
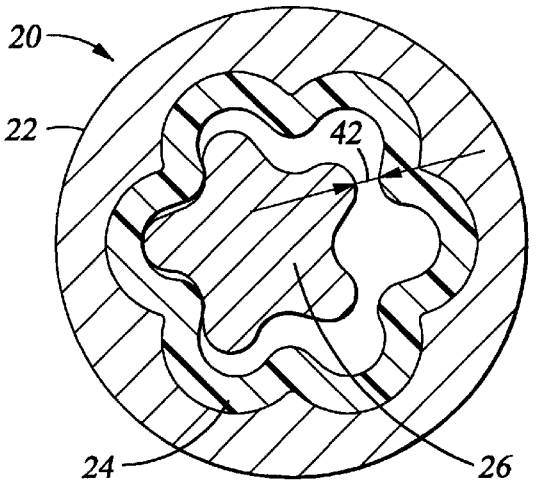
FIG. 15 is a schematic cross sectional view of the pumping/power section of the PCP shown in FIG. 14 at section 15.

FIG. 14 is a schematic cross sectional view of a portion of a PCP having the tapered rotor 26 in a second position. FIG. 15 is a schematic cross sectional view of the pumping/power section of the PCP 20 shown in FIG. 14 at section 15 and will be described jointly with FIG. 14. The rotor 26 has been adjusted in the direction of the larger diameters of the stator, which is upward in FIG. 14. The fit between the rotor and the stator in the second position is different than the fit in the first position. As an example, FIG. 15 shows a clearance 42 between the rotor and the stator in contrast to the interference fit shown in FIG. 9. The adjustment between the rotor and stator fit can be made manually or automatically and can account for variations in operating conditions. For example, the fit between the rotor and the elastomeric member could be increased to achieve increased pumping efficiency, if the elastomeric member 24 was worn. Further, if an operation temporarily swells the elastomeric member, such as pumping steam downhole, the rotor can be adjusted for a looser fit to allow for the swelling and then readjusted to a desired fit after the swelling subsides.

As another example, a pump disposed downhole generally leaves a column of fluid above the pump that impedes the pump when it starts to rotate again. The relative position of the rotor with the stator can be adjusted to provide clearance and "unload" the pump to drain the column of fluid. Thus, the pump can start easier and lessen an initial load on, for example, an electric motor driving the pump.

Conversely, the rotor could be moved to a second position that is further inward toward the second portion 23, shown in FIG. 5, compared to the first position, i.e., in the direction of the smaller rotor diameter. Further, it may be desirable to selectively change an interference fit to different interference fit or even a clearance fit to allow passage of various fluids, such as fluids containing particulate matter.

Figure 16:
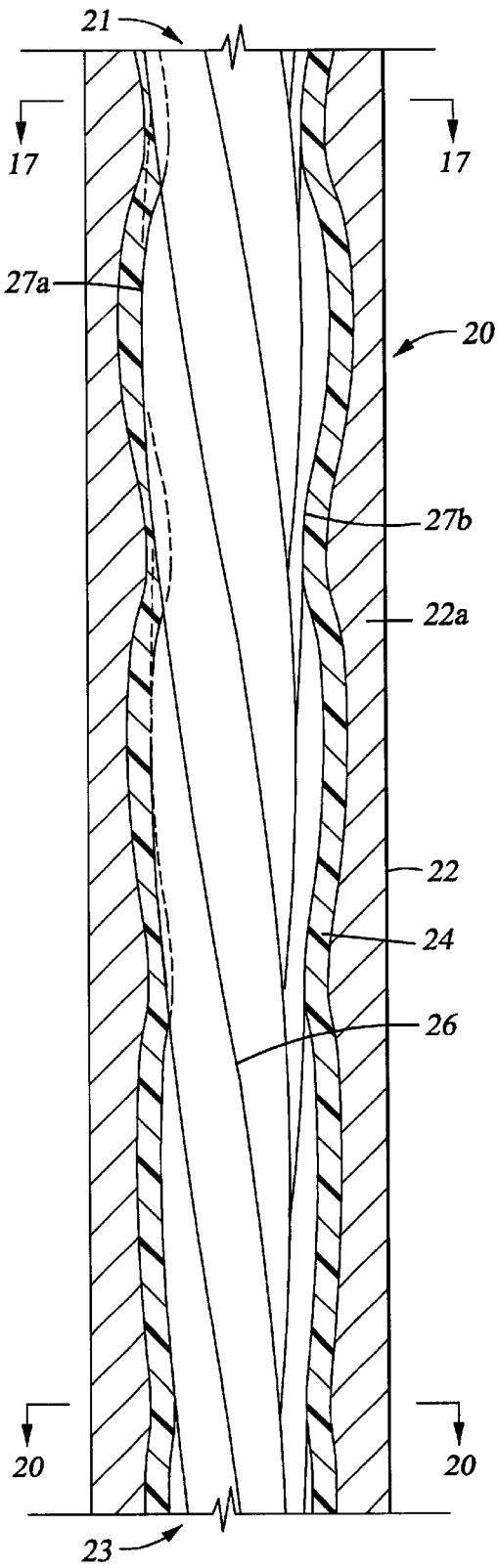
FIG. 16 is a schematic cross sectional view of a portion of a PCP having a tapered thread height.

FIG. 16 is a schematic cross sectional view of a portion of a PCP having a tapered thread height. The PCP 20 includes a stator 22 with an elastomeric member 24 and a rotor 26 disposed therethrough. The placement of the rotor 26 in the stator 22 creates a first cavity 28, a second cavity 30 and a third cavity 32, described in reference to FIG. 5.

Figure 17:
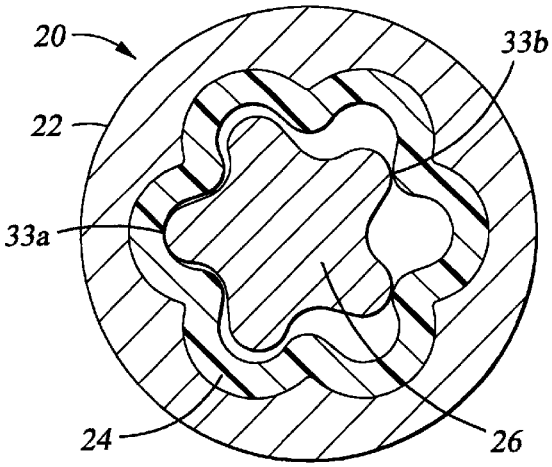
FIG. 17 is a schematic cross sectional view of the pumping/power section of the PCP shown in FIG. 16 at section 17.
Figure 18:
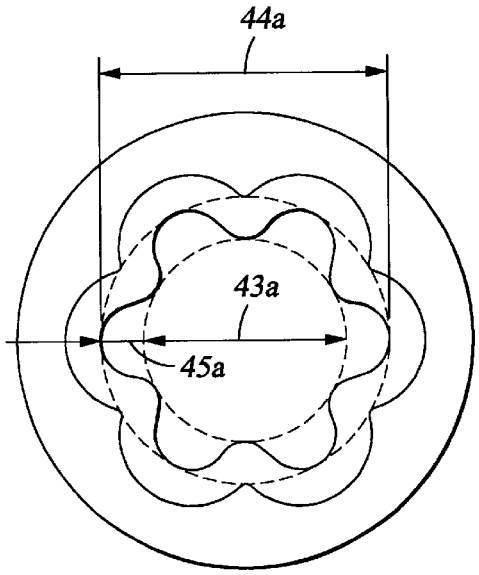
FIG. 18 is a schematic cross sectional view of diameters of the stator shown in FIG. 17.
Figure 19:
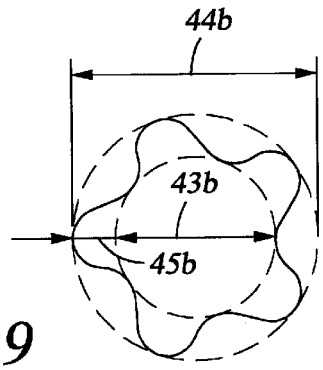
FIG. 19 is a schematic cross sectional view of diameters of the rotor shown in FIG. 17.

FIG. 17 is a schematic cross sectional view of the pumping/power section of the PCP shown in FIG. 16 at section 17. FIG. 18 is a schematic cross sectional view of diameters of the stator shown in FIG. 17. FIG. 19 is a schematic cross sectional view of diameters of the rotor shown in FIG. 17. FIGS. 17–19 will be described jointly and similar elements are similarly numbered. The rotor 26 is disposed within the stator 22. The elastomeric member 24 engages the rotor as the rotor rotates within the stator. For example, the rotor engages the elastomeric member at a portion 33*a* and engages a distal portion 33*b* at least partially along the helical threads to generally form an interference fit with the stator through the elastomeric member. Alternatively, the elastomeric member can be coupled to the rotor and engage teeth formed on the stator in similar fashion, as has been described herein. The stator has a minor diameter 43*a*, a major diameter 44*a* and a resulting thread height 45*a*, shown in FIG. 18. The rotor has a corresponding minor diameter 43*b*, a major diameter 44*b* and a resulting thread height 45*b*, shown in FIG. 19. In one embodiment, the rotor and/or stator have a constant minor diameter at least partially along the length of the PCP 20, i.e., the minor diameter is the same across two or more of the stages of the PCP 20. Alternatively, the minor and/or major diameters can taper as well as the thread height, so that the diameters and the thread height progressively taper along the rotor and/or stator.

Figure 20:
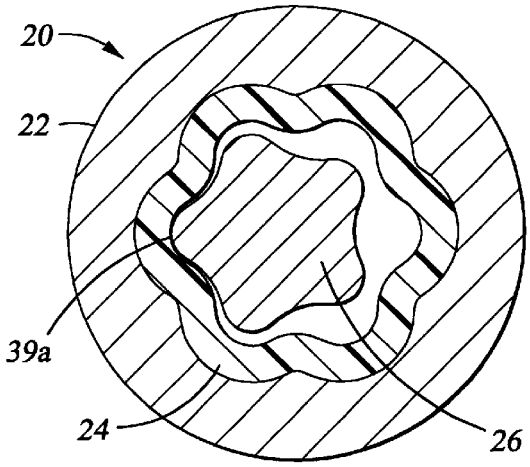
FIG. 20 is a schematic cross sectional view of the pumping/power section of the PCP shown in FIG. 16 at section 20.
Figure 21:
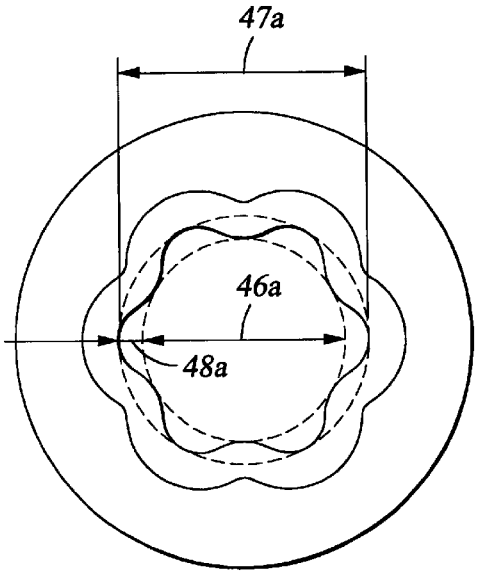
FIG. 21 is a schematic cross sectional view of diameters of the stator shown in FIG. 20.
Figure 22:
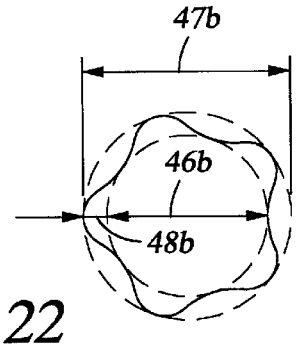
FIG. 22 is a schematic cross sectional view of diameters of the rotor shown in FIG. 20.

FIG. 20 is a schematic cross sectional view of the pumping/power section of the PCP shown in FIG. 16 at section 20. FIG. 21 is a schematic cross sectional view of diameters of the stator shown in FIG. 20. FIG. 22 is a schematic cross sectional view of diameters of the rotor shown in FIG. 20. FIGS. 20–22 will be described jointly and similar elements are similarly numbered. The stator has a minor diameter 46*a*, a major diameter 47*a* and a resulting thread height 48*a*, shown in FIG. 21. The rotor has a corresponding minor diameter 46*b*, a major diameter 47*b* and a resulting thread height 48*b*, shown in FIG. 22.

The rotor 26 has a smaller thread height at section 17 than at section 20, shown in FIG. 16, and can form a progressive taper in at least a portion of the pumping section of the PCP 20. The elastomeric member 24 engages the rotor as the rotor rotates within the stator, because the stator is tapered correspondingly to the rotor. For example, the rotor engages the elastomeric member at a portion 39*a*.

Figure 23:
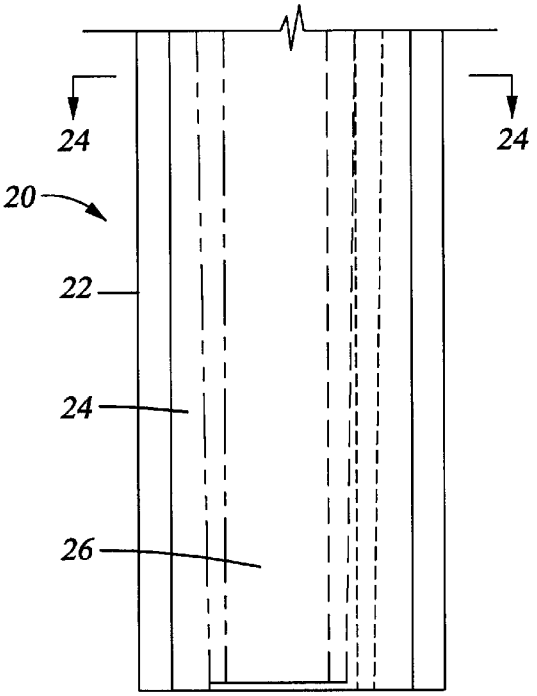
FIG. 23 is a schematic cross sectional view of a portion of a PCP having a tapered rotor in a first position.
Figure 24:
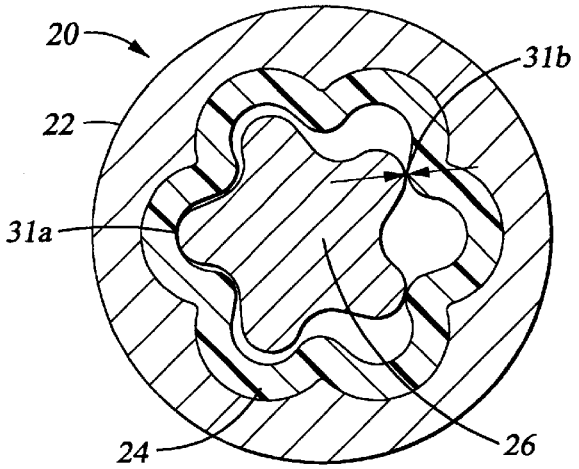
FIG. 24 is a schematic cross sectional view of the pumping/power section of the PCP shown in FIG. 23 at section 24.

FIG. 23 is a schematic cross sectional view of a portion of the PCP 20 with the tapered rotor and/or stator in a first position. FIG. 24 is a schematic cross sectional view of the pumping/power section of the PCP shown in FIG. 23 at section 24. Similar elements are similarly numbered and the figures will be described jointly. When the rotor is engaged with the stator, the relative fit between the rotor and stator is in a first condition, so that, for example, normal pumping can occur. The first condition could be a predetermined operating condition for which the pump was designed without wear and swelling of the components. The rotor can contact the stator at, for example, portions 31*a* and 31*b*.

Figure 25:
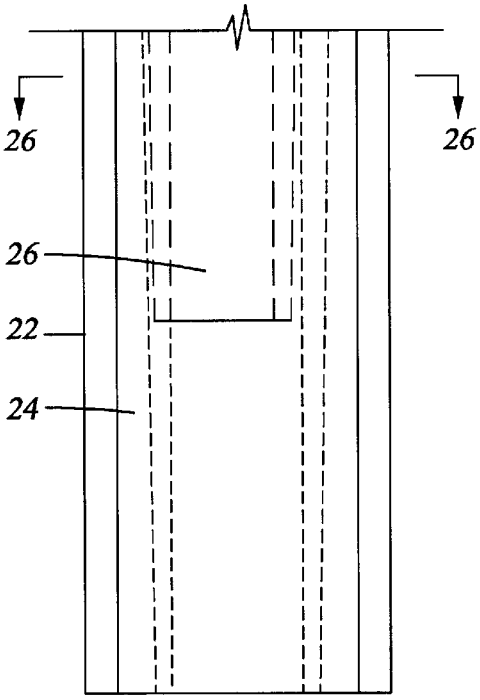
FIG. 25 is a schematic cross sectional view of a portion of a PCP having a tapered rotor in a second position.
Figure 26:
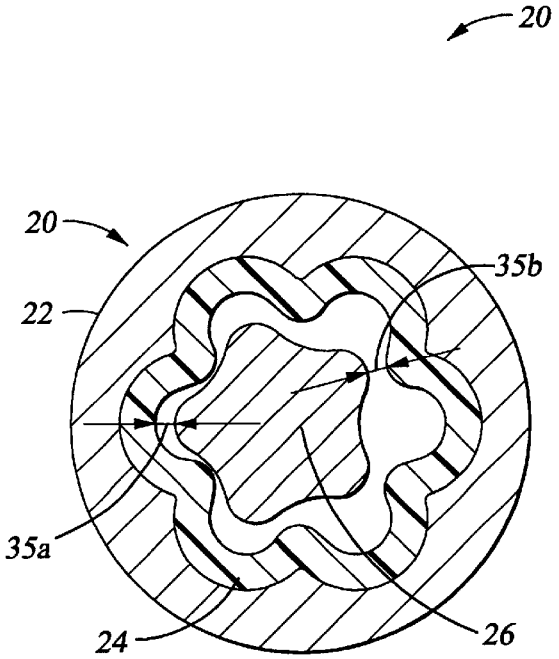
FIG. 26 is a schematic cross sectional view of the pumping/power section of the PCP shown in FIG. 25 at section 26.

FIG. 25 is a schematic cross sectional view of a portion of a PCP having the tapered rotor 26 in a second position. FIG. 26 is a schematic cross sectional view of the pumping/power section of the PCP 20 shown in FIG. 25 at section 26 and will be described jointly with FIG. 25. The rotor 26 has been adjusted in the direction of the larger thread height of the stator, which is upward in FIG. 25. The fit between the rotor and the stator in the second position is different than the fit in the first position. As an example, FIG. 26 shows a clearance 35*b* between the rotor and the stator. Further, a clearance 35*a* may also occur between the rotor and the stator because of the difference in thread heights.

Figure 27:
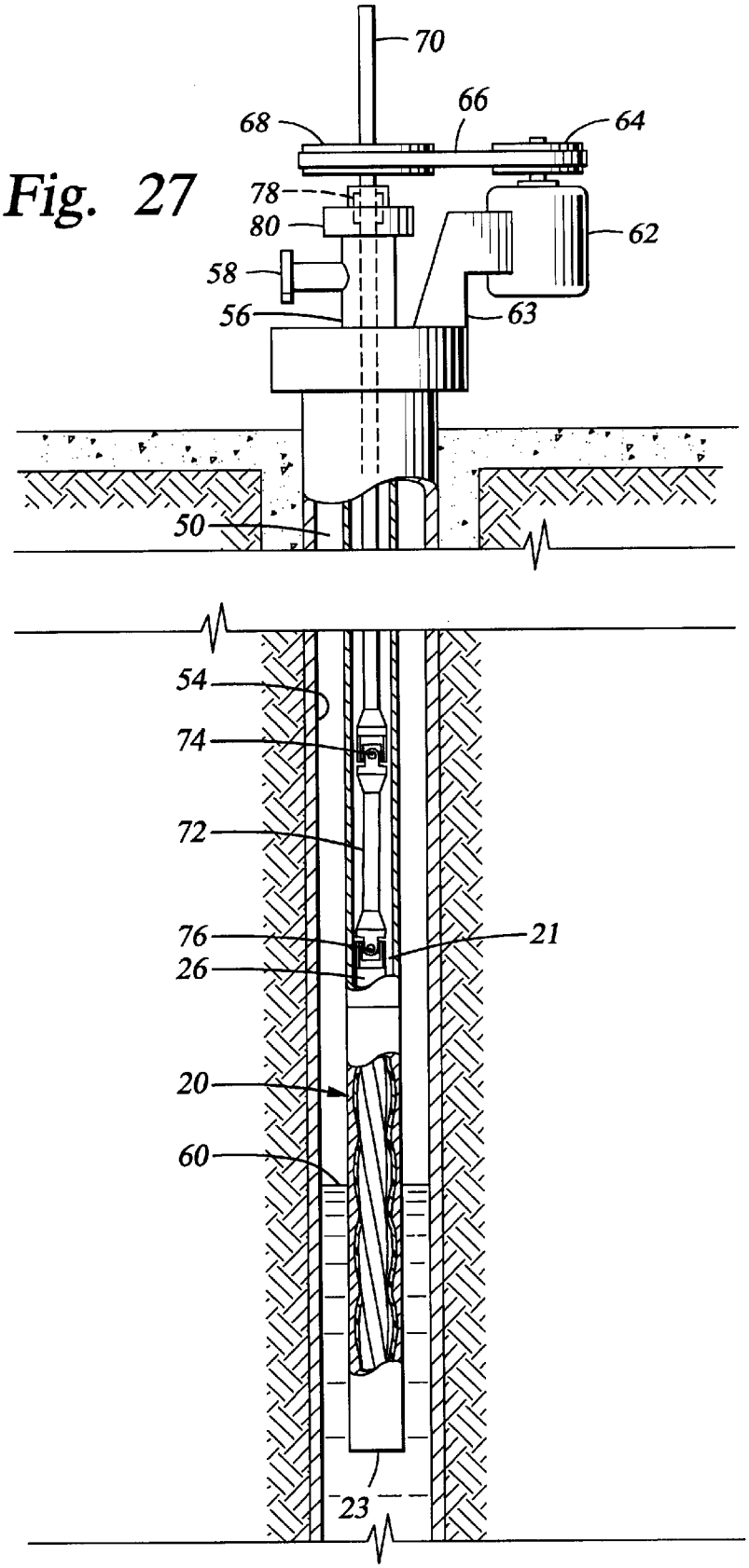
FIG. 27 is a schematic cross sectional view of a PCP mounted downhole in a wellbore.
Figure 28:
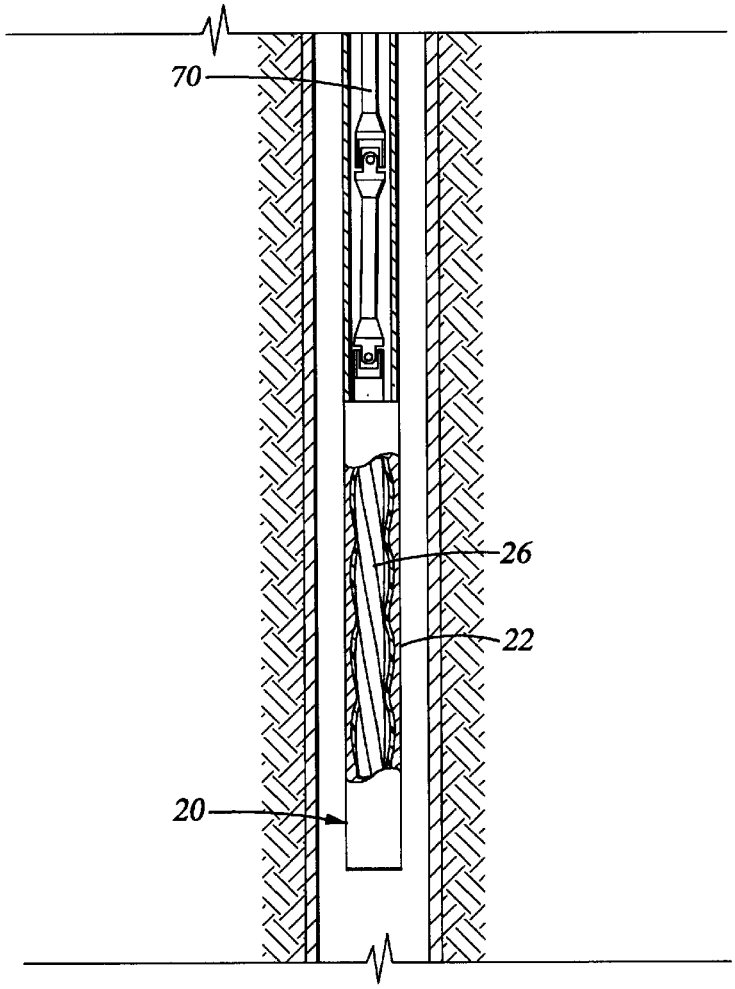
FIG. 28 is a schematic cross sectional view of a shaft coupled to a motor.

FIG. 27 is a schematic cross sectional view of a PCP mounted downhole in a wellbore. The PCP 20 is disposed in a wellbore 50 formed in the earth 52, which includes dry land or subsea formations. Generally, the wellbore 50 is cased with a casing 54 to stabilize the hole in the earth 52. A tubular member 56 is generally inserted into the wellbore 50 for flowing fluids from or to the PCP 20. The tubular member 56 includes a port 58 through which fluids can enter and exit the tubular member 56. If the PCP 20 is used as a pump, generally, the wellbore contains some amount of production fluid 60. A motor 62 and a support member 63 are coupled to the PCP 20 through a drive member 64, a drive transfer member 66 coupled to the drive member 64, a second drive member 68 coupled to the drive transfer member 66 and a shaft 70 coupled to the second drive member 68. Coupling, as used herein, can include attaching, affixing, manufacturing, molding, linking, relating or otherwise associating elements together, which can be direct or indirect through intermediate elements. Alternatively, the motor 62 can be coupled directly to the shaft 70 without the intermediate drive members, as shown in FIG. 28. The drive member 64 can be, for example, a pulley or sprocket, the drive transfer member 66 can be a chain or belt, and the second drive member can be a corresponding pulley or sprocket. The shaft 70 can be inserted through the tubular member 56 and through a bearing and/or packing element 78 disposed in a top 80. The top 80 can be coupled to the tubular member 56. The shaft 70 is coupled to the rotor 26 by an intermediate shaft 72 having generally two universal joints 74 and 76 coupled therebetween. The universal joints allow the rotor 26 to precess as well as rotate within the stator 22. Fluid can be pumped up the wellbore from the second opening 23 through the progressive cavities formed between the stator 22 and the rotor 26 and then through the tubular member 56 and out the port 58. Conversely, fluid can be pumped downhole by entering the port 58, translating the fluid down the tubular member 56 through the first opening 21 and out the second opening 23. If the PCP 20 is used as a downhole motor, generally, the tubular member 56 would be used to flow fluid downward through the first opening 21 and out the second opening 23. The motor 26 would be coupled to a drive shaft extending from the rotor through the second opening 23 for operating downhole equipment, such as mills and drill bits.

FIG. 28 is a schematic cross sectional view of a shaft coupled to a motor. The wellbore 50 includes a tubular member 56 inserted therein and a shaft 70 extending therethrough. The drive motor 62 is shown directly coupled to the shaft 70 through a coupling 84 as an alternative embodiment compared to the arrangement shown in FIG. 27. The motor 62 is supported by a support member 65. The support member 65 can be a stationary support member, such as a steel frame, or can be adjustable by using, for example, hydraulic or pneumatic cylinders, adjustable brackets that can be bolted in various positions, and other devices and methods. The motor 62 generally includes a drive shaft 82 which can be engaged with the coupling 84 on one end of the coupling. The coupling 84 can be engaged with the shaft 70 on another end of the coupling. The coupling may be a fixed engagement, such that there is little to no rotational movement relative between the drive shaft 82 and the shaft 70. Alternatively, the coupling 84 can be a slip or frictional drive coupling known to those in the art, such that the coupling may slip under certain conditions, such as an excessive amount of torque on the shaft 70. The shaft 70 can be adjusted longitudinally up and down relative to the coupling 84 and relative to the stator 22. The adjustments can change the relative position of the rotor 26 with the stator 22, described in FIGS. 5–26. An adjustor 88 can be used to longitudinally translate or adjust the shaft 70. One exemplary adjustor 88 will be described in FIG. 30. The length of the coupling engaged with the shaft 70 can be determined by the amount of the adjustment anticipated for the shaft 70 as the rotor 26 is longitudinally adjusted in the PCP 20. Similarly, the motor 62 and the shaft 70 can both be longitudinally adjusted to change the rotor and stator engagement positions.

Further, in the embodiment shown in FIG. 28, the shaft 70 is shown to be adjusted by the adjustor 88, so that the rotor is adjusted relative to the stator, where the stator is relatively stationary. The adjustor 88 may also adjust the stator, for example, by adjusting the tubular member 56 up and down the wellbore 50, while the shaft 70 and rotor 26 attached thereto remain relatively stationary. Further, both the rotor and the stator can be adjusted longitudinally. For example, the adjustor 88 could be coupled to the support member 65 as shown in dotted lines, for example, to adjust both components.

Figure 29:
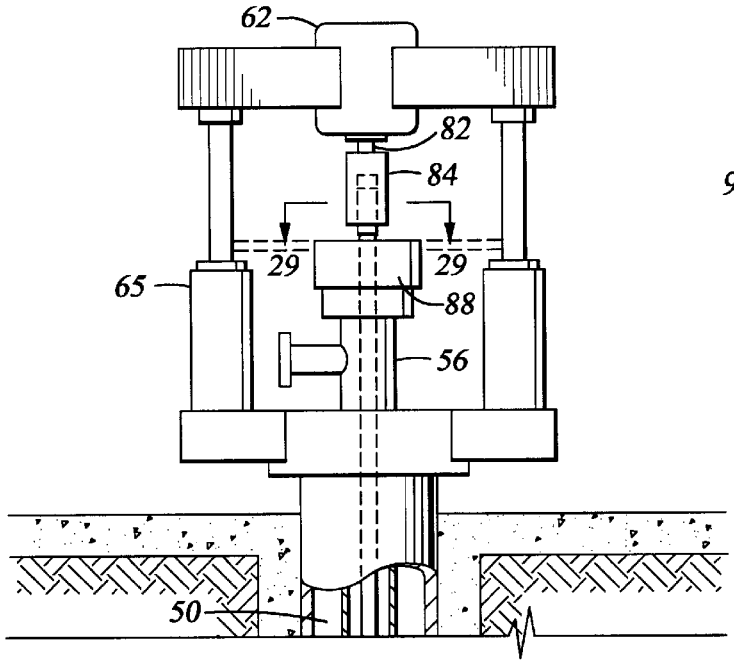
FIG. 29 is a schematic cross sectional view of the coupling 84 engaged with the shaft 70 shown in FIG. 28.
Figure 29:
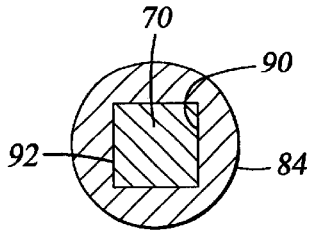

FIG. 29 is a schematic cross sectional view of the coupling 84 engaged with the shaft 70, shown in FIG. 28. As one example, the coupling 84 has a rectangular opening with edges 90 that engage a correspondingly shaped portion 92 on the shaft 70. As another example, the coupling 84 can includes a series of splined teeth (not shown) that engage similarly shaped portion on the shaft. The engagement of the motor 62 to the shaft 70 can be accomplished in a variety of other ways and the embodiment shown in FIGS. 28–29 is merely exemplary. For instance, the shaft 70 can formed so that a coupling is integral to the shaft 70 and the mating surfaces are directly formed on the drive shaft 82. Further, the drive shaft 70 can be pinned to the shaft 82 or to the coupling 84 at a variety of longitudinally positions corresponding to a desired location of the rotor relative to the stator. Further, a similar coupling can be used for one or more of the drive members, shown in FIG. 27.

The adjustment of the rotor relative to the shaft can be accomplished by a variety of mechanisms and procedures. For example, the adjustor 88, shown schematically in FIG. 28, can be a collar that surrounds the periphery of the shaft and can be tightened around the shaft to frictionally avoid slippage along the length of the collar, or a weldment on the shaft that protrudes from the shaft, and other devices and methods known to those in the art. Further, the adjustor can be a clamp that clamps the shaft at a certain height after the shaft is raised or lowered to a position. Other types of adjustors are possible and included within the meaning of the term "adjustor" herein that allows the rotor to be supported at and/or adjusted to a relative position with the stator.

Figure 30:
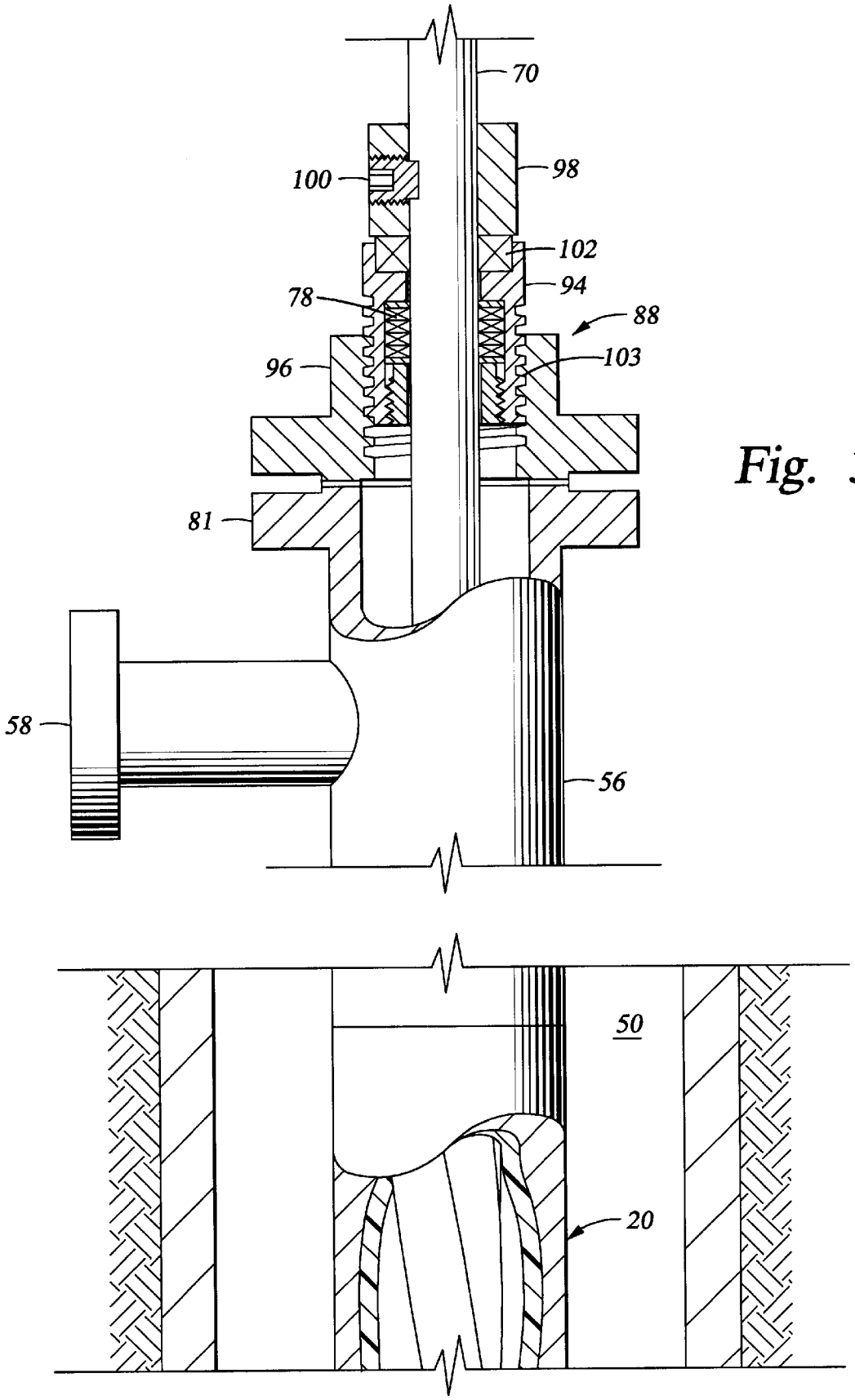
FIG. 30 is a schematic cross sectional view of one embodiment of an adjustor for a shaft.

FIG. 30 is a schematic cross sectional view of one example of an adjustor for a shaft. The tubular member 56 with a port 58 is disposed within the wellbore 50. A top 81 is formed with or coupled to the tubular member 56. The shaft 70 is disposed through the tubular member 56 and passes through at least a portion of an adjustor 88 coupled to the shaft. The shaft 70 can be sealed by a bearing and/or packing element 78 disposed in the adjustor 88. The element 78 could also be disposed in the tubular member 56, top 81, or other locations, so that fluid in the wellbore is restricted from passing therethrough. The adjustor 88 includes a first portion 94 and a second portion 96. The first portion 94 and the second portion 96 are adjustably engaged with each other at an engagement section 103, so that the first portion 94 of the adjustor can translate up and down in the second portion 96. For example, the engagement section 103 can include mating threads, so that rotating the first portion 94 and/or second portion 96 extends or contracts the adjustor. Other types of engagement include, for example, gears, sprockets, and linkages. A stop 98 is coupled to the shaft 70 and engages the adjustor 88 to translate the relative movement between the first and second portions of the adjustor 88 to the shaft 70. Alternatively, a coupling between a motor and the shaft, having a larger diameter than the shaft, could be used as the stop 98. It is believed that the weight of the shaft 70 and the PCP 20 will maintain the stop 98 in contact with the adjustor 88. However, if additional restriction is necessary, a corresponding stop (not shown) can be located below the first portion 94 to restrict the upward movement of the shaft 70 relative to the adjustor 88. A bearing 102 can be disposed between the stop 98 and the adjustor 88 to reduce frictional contact therebetween.

Figure 31:
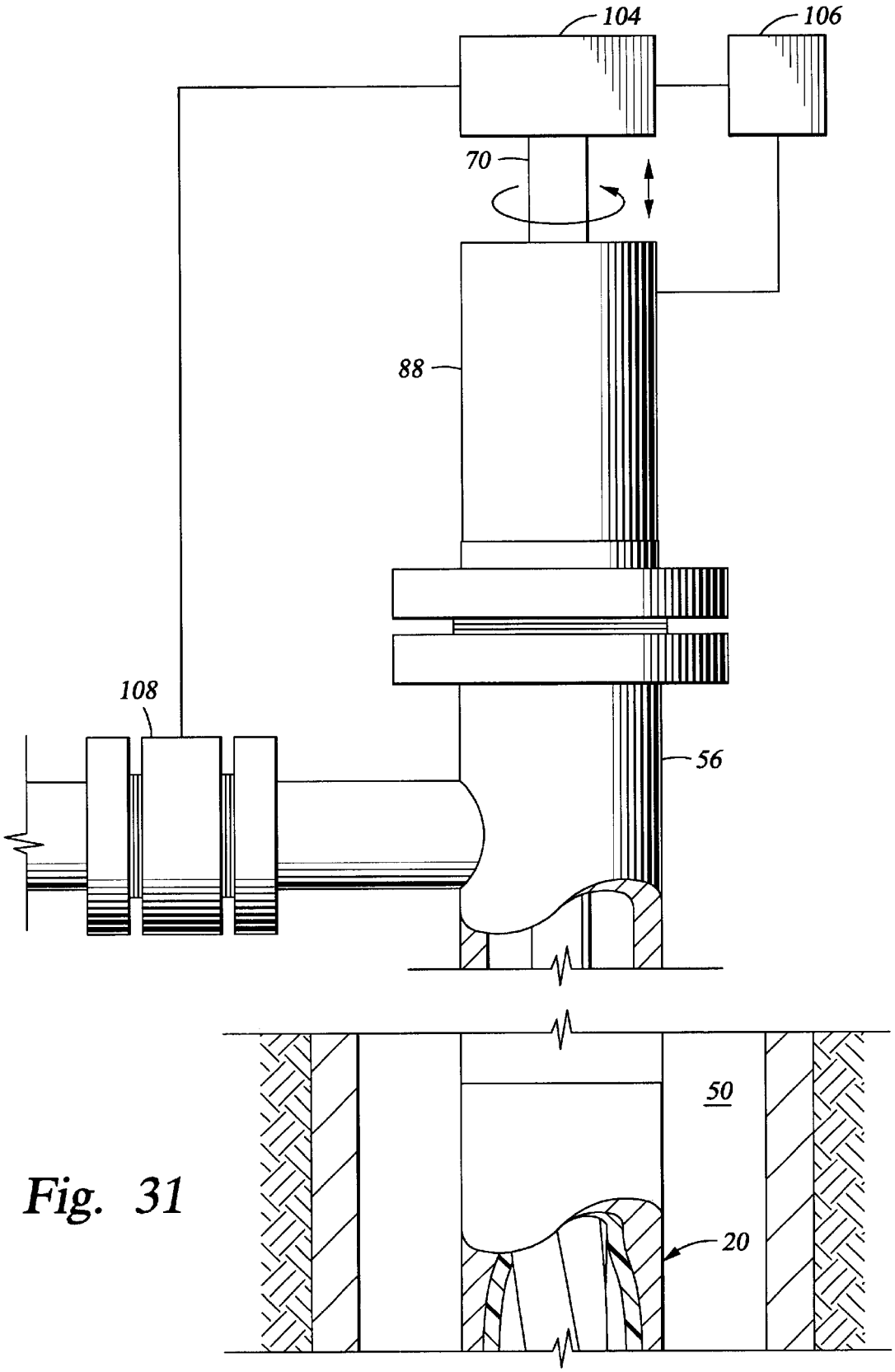
FIG. 31 is a schematic cross sectional view of a sensor coupled to an adjustor for the shaft.

FIG. 31 is a schematic cross sectional view of a sensor and a controller coupled to an adjustor 88 for the shaft 70. A tubular member 56 is disposed within a wellbore 50. An adjustor 88 is coupled to the shaft 70 and disposed above the tubular member 56. Alternatively, the adjustor can be disposed downhole within the wellbore 50 or within the tubular member 56. A sensor 104 is directly or indirectly coupled to the shaft 70 and senses the movement of the shaft 70. For example, the sensor 104 can measure the amount of torque on the shaft 70 created by the interaction of the rotor 26 rotating within the stator 22, described in reference to FIGS. 5–26. The sensor can measure other aspects, such as rotational speed, flow through a flow meter 108, shown in dotted lines, and other aspects of the PCP 20 in operation. The sensor generally would output some reading, such as electronically, audibly, visibly or by other means, so that an operator can make longitudinal adjustments of the engagement between the rotor and stator with the adjustor 88.

In some embodiments, a controller 106 may be coupled to the sensor 104 and the adjustor 88. The controller could receive output from the sensor 104 and create an output, using for example using a programmed sequence in a microprocessor and provide a signal to the actuator 88. The actuator 88 then could raise and lower or otherwise longitudinally adjust the position of the rotor and/or stator automatically. For example, the adjustor 88 could include a servomotor coupled to the shaft 70 to receive output from the controller 106 and longitudinally adjust the shaft 70. Further, the adjustor 88 could include hydraulic and/or pneumatic cylinders coupled to the shaft 70 that raise and lower or otherwise longitudinally adjust the rotor and/or stator. As another example, the adjustor 88 could include a gear motor or other gear arrangement that rotates a portion of the adjustor, such as the first portion 94 within the second portion 96 shown in FIG. 30, to translate or otherwise longitudinally adjust the shaft 70 up and down and, therefore, adjust the interface between the rotor and stator. While it is contemplated that the shaft 70 coupled to the rotor would generally be adjusted, it is to be understood that the present description includes adjusting the stator in addition to or in lieu of the rotor, for example, by raising and lowering the tubular member 56. The adjustor 88 may therefore be coupled to either the shaft 70 or the tubular member 56 or both to effect the relative longitudinal positions between the rotor 26 and the stator 22 in the PCP 20.

Figure 32:
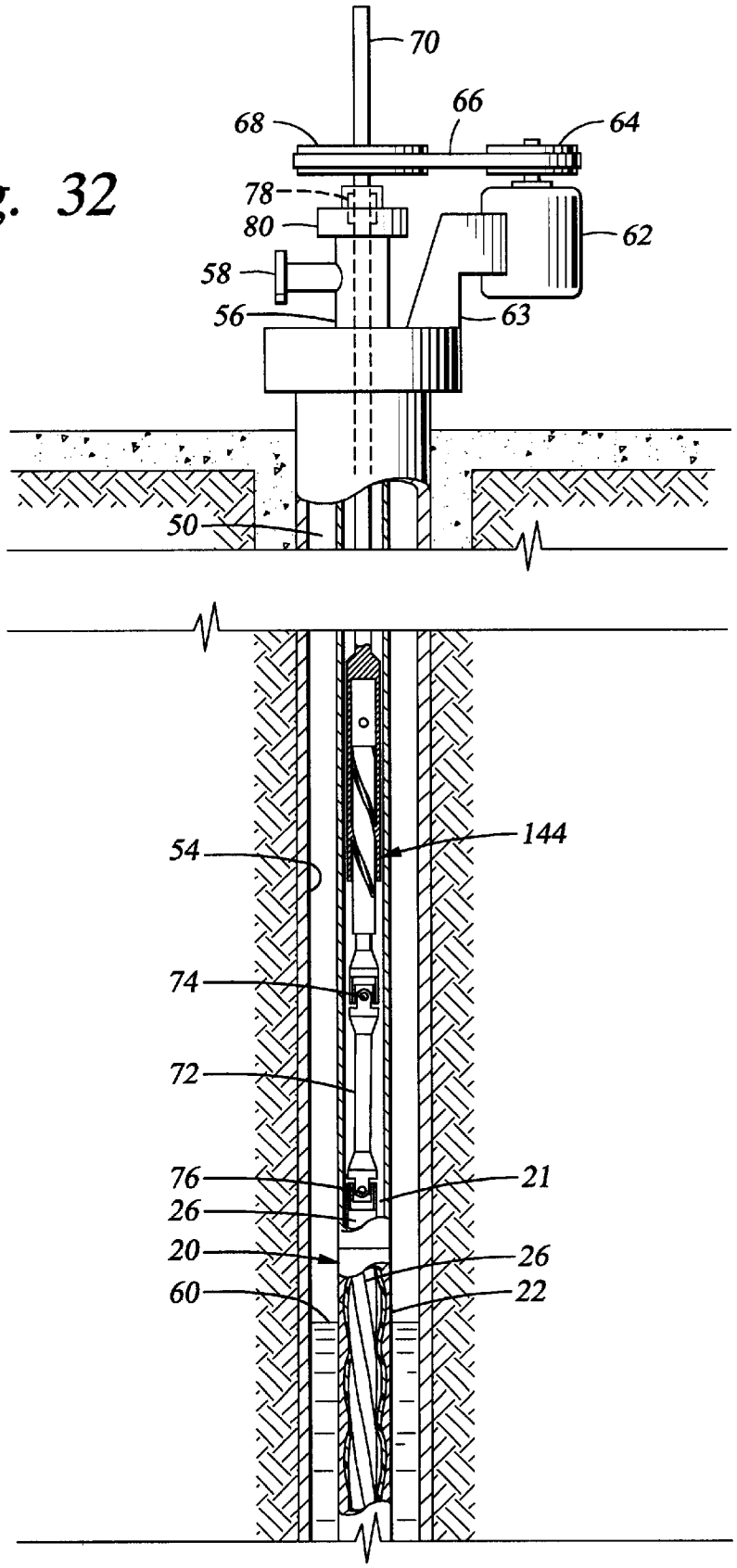
FIG. 32 is a schematic cross sectional view of an adjustable coupling coupled to a PCP.

FIG. 32 is a schematic cross sectional view of an adjustable coupling 144 as another example of an adjustor. The coupling 144 can be disposed downhole in the wellbore 50 and mechanically adjust the contact of the rotor 26 with the stator 22 in the PCP 20, by, for example, responding to excessive torque created between the rotor and stator. The coupling generally is disposed along the shaft 70, intermediate shaft 72 or rotor 26 to allow the rotor to adjust within the stator.

Figure 33:
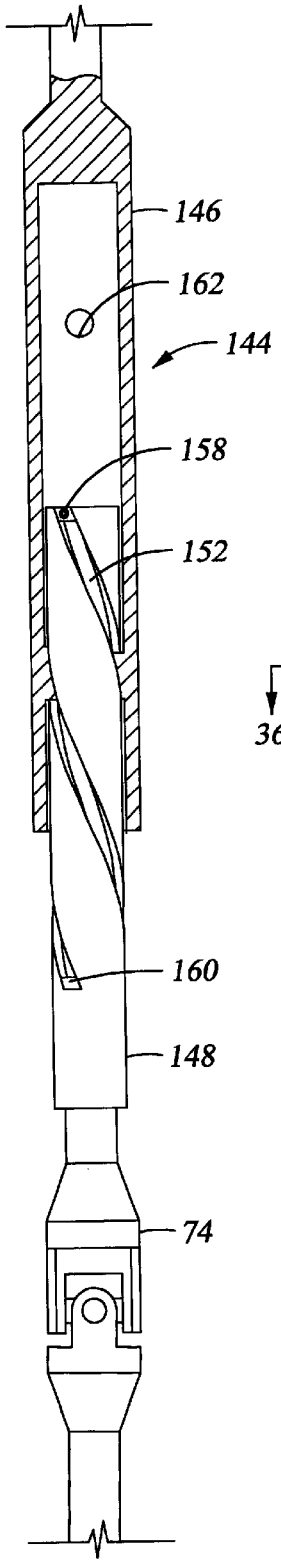
FIG. 33 is a schematic cross sectional detail of the adjustable coupling shown in FIG. 32 in a first position.
Figure 34:
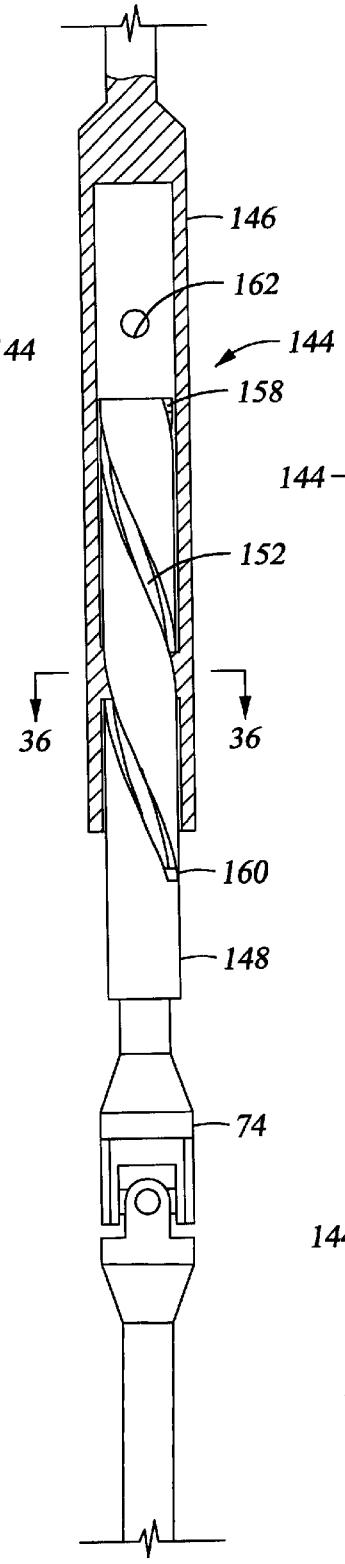
FIG. 34 is a schematic cross sectional detail of the adjustable coupling shown in FIG. 33 in a second position.

FIG. 33 is a schematic cross sectional detail of the adjustable coupling shown in FIG. 32 in a first position. FIG. 34 is a schematic cross sectional detail of the adjustable coupling shown in FIG. 33 in a second position and will be described jointly with FIG. 33. The coupling 144 includes a coupling first portion 146, such as a sleeve, and a coupling second portion 148, such as a shaft. The first portion 146 has one or more internal protrusions 150, such as pins, threads or other members, that engage threads 152 on the second portion 148. Alternatively, the protrusions 150 can be coupled to the second portion and the threads 152 coupled to the first portion. Other means for engaging the first portion and second portion can include a sprocket with ratcheting teeth, a conical shaft, gears and other engagement devices. A seal 154 can be disposed between the first portion and the second portion to seal the interior of the coupling from the ambient environment. A first stop 158 is disposed above the protrusion 150 and a second stop 160 is disposed below the protrusion to limit the travel of the second portion relative to the first portion. The threads 152 are formed on the second portion 148 at an angle Φ with respect to a longitudinal axis through the second portion.

Figure 35:
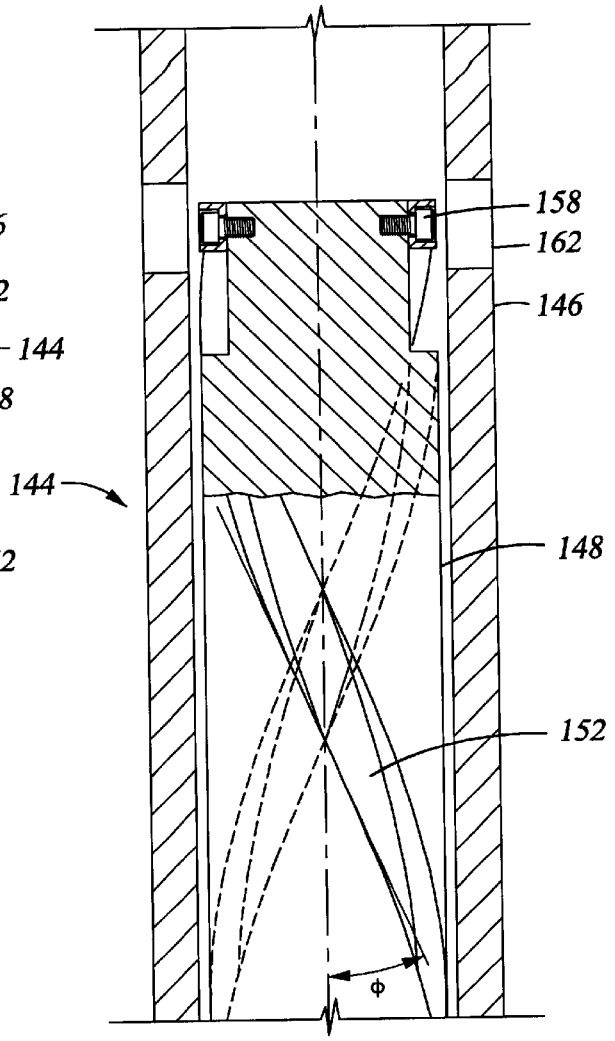
FIG. 35 is a schematic cross sectional detail of a stop for the adjustable coupling shown in FIGS. 33–34.

FIG. 35 is a schematic cross sectional detail of a stop for the adjustable coupling shown in FIGS. 33–34. The second portion 148 can include one or more stops 158 disposed at a location on the second portion to limit the extension of the second portion in the first portion 146. The stops can be permanently or removably coupled to the second portion and can include a threaded fastener 158. One or more access ports 162 can be formed in the first portion 146, so that the stops 158 can be coupled to the second portion. The ports 162 can be plugged or otherwise sealed after the stops are coupled to the second portion. Generally, the second portion 148 is inserted into the first portion 146 and the stops 158 coupled to the second portion after insertion.

Figure 36:
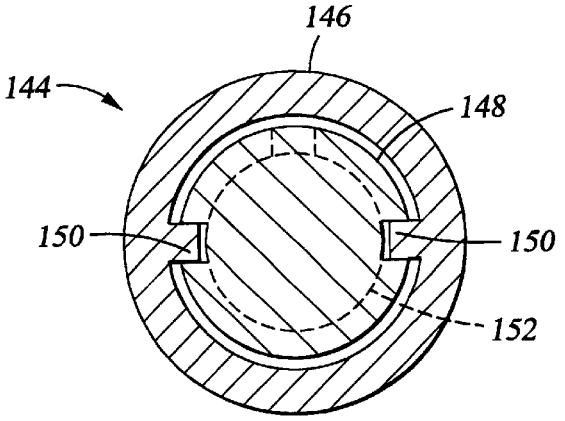
FIG. 36 is a schematic cross sectional view of the adjustable coupling shown in FIG. 35 at section 36.

FIG. 36 is a schematic cross sectional view of the adjustable coupling shown in FIG. 35 at section 36, as one example of the protrusions 150. One or more protrusions 150 extend from the first portion 146 and engage the second portion 148. The protrusions can be segmented or continuous, such as mating threads, or other engagement members to couple the first portion with the second portion.

Referring to FIGS. 32–36, in operation, the weight of the rotor 26, any tools and any portions of shaft coupled to the second portion pull the second portion down until either the protrusion 150 engages the second stop 160 or the rotor 26 engages the stator 22. As the motor 62 rotates the shaft 70 and, thus, the first portion 146, the first portion 146 transmits a torsional force to the second portion 148 and thence to the rotor 26 through the engagement between the protrusion 150 and threads 152. The force has a vertical component acting along the longitudinal axis and a horizontal component acting perpendicular to the longitudinal axis, where the relative magnitude of the force components depend on the angle Φ. The horizontal component of the resulting force acts to rotate the second portion and, thus, the rotor 26 is rotated within the stator 22. The vertical component of the torsional force and other forces, such as any force caused by interference engagement between the rotor and stator generally act to raise the second portion relative to the first portion. However, the weight of the second portion 148 and components disposed below the second portion generally pulls the components down. The angle Φ can be selected in combination with the torsional forces and weight of components and other forces, so that under normal operating conditions, the vertical forces are relatively balanced so that the rotor engages the stator at a first position. However, if resistance increases, for example, by the elastomeric member swelling, the torque required to rotate the rotor is increased and the vertical force component is also increased. The increased vertical component overcomes the weight and pulls the second portion 148, rotor 26 and other coupled components upward in the first portion 146 to a second portion to reestablish an equilibrium. Similarly, as torque reduces, the vertical component of the force is decreased and the second portion slides downward to reestablish the equilibrium between the weight, friction and torsional forces.

Figure 37:
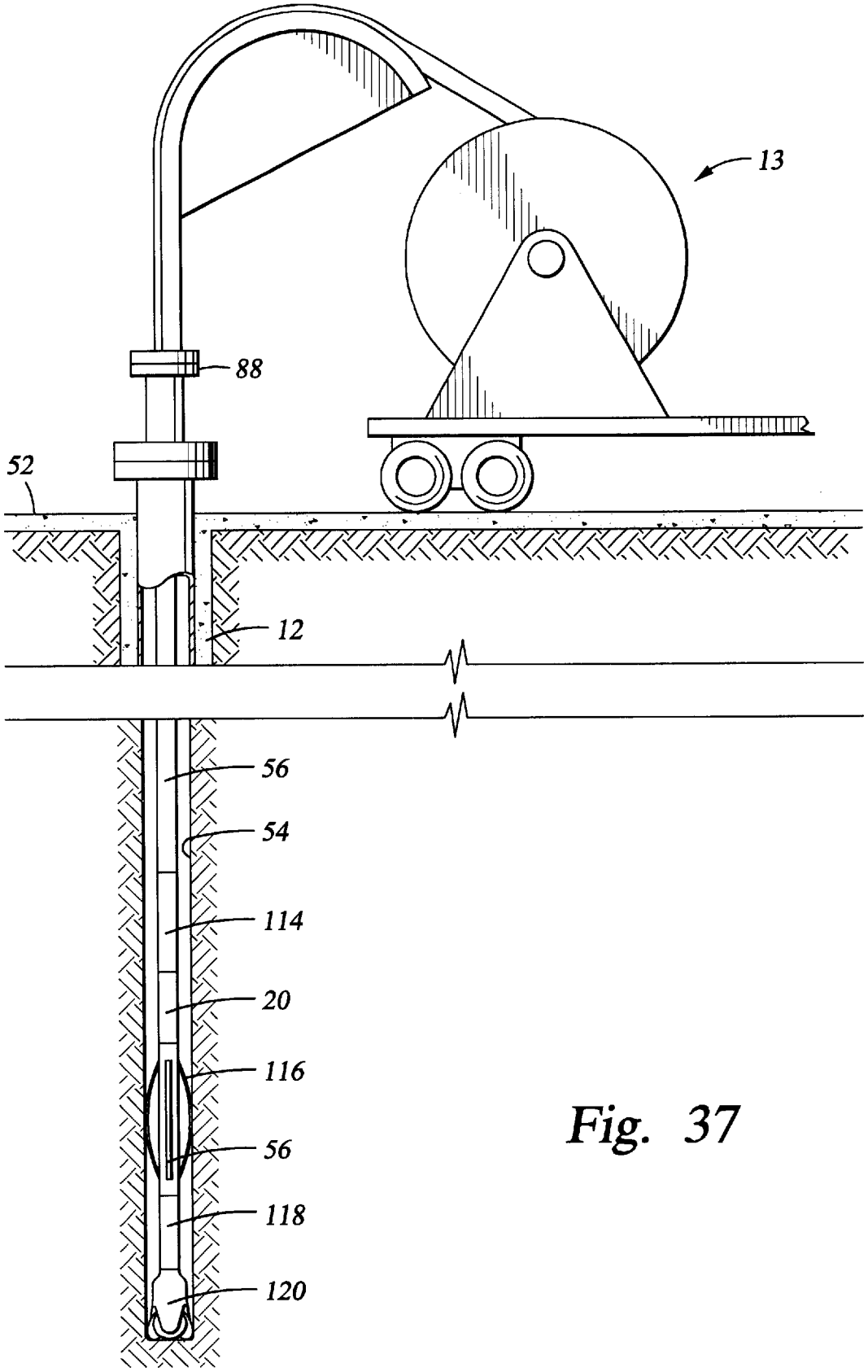
FIG. 37 is a schematic cross sectional view of a PCP used as a downhole motor.

FIG. 37 is a schematic cross sectional view of a PCP used as a downhole motor. The wellbore 50 includes a casing 54 disposed therein and a tubular member 56 disposed within the casing 54. The embodiment shown in FIG. 37 includes one exemplary set of components that can be used with a PCP 20 when the PCP is used as a downhole motor for various tools. A position measuring device 114, such as an MWD, is coupled to the tubular member 56. A PCP 20 is coupled to the position measuring device 114. A stabilizer sub 116 is coupled to the PCP 20 to maintain the alignment of the components within the wellbore 50. A cutting tool 120 is coupled to the assembly and includes, for example, a drill bit. If the cutting tool 120 is an end mill, the assembly may also include a cutting tool 118, such as a spacer mill, coupled between the stabilizer and the end mill. A drill bit is generally used to drill into a formation in the earth 52 and an end mill is generally used to cut an exit through a casing 54, shown in FIG. 27. An adjustor 88 can be coupled to either the rotor or stator as has been described above for adjusting the interface between the rotor and the stator. Fluid flowing down the tubular member 56, which may be coiled tubing, causes the rotor to rotate within the stator. The rotor rotates the cutting tool 120 or other device.

Figure 38:
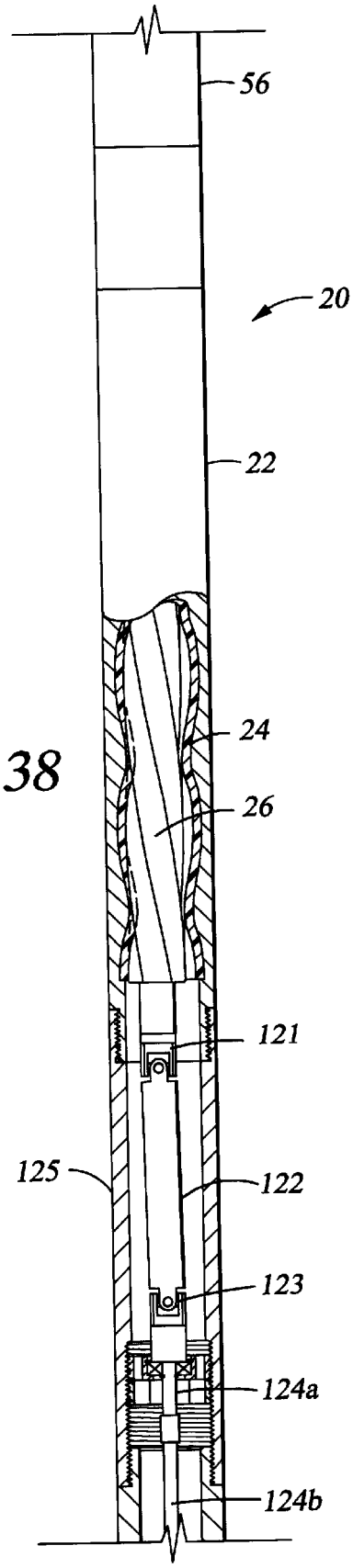
FIG. 38 is a schematic cross sectional view of one embodiment of an adjustable rotor for a PCP used as a motor.
Figure 39:
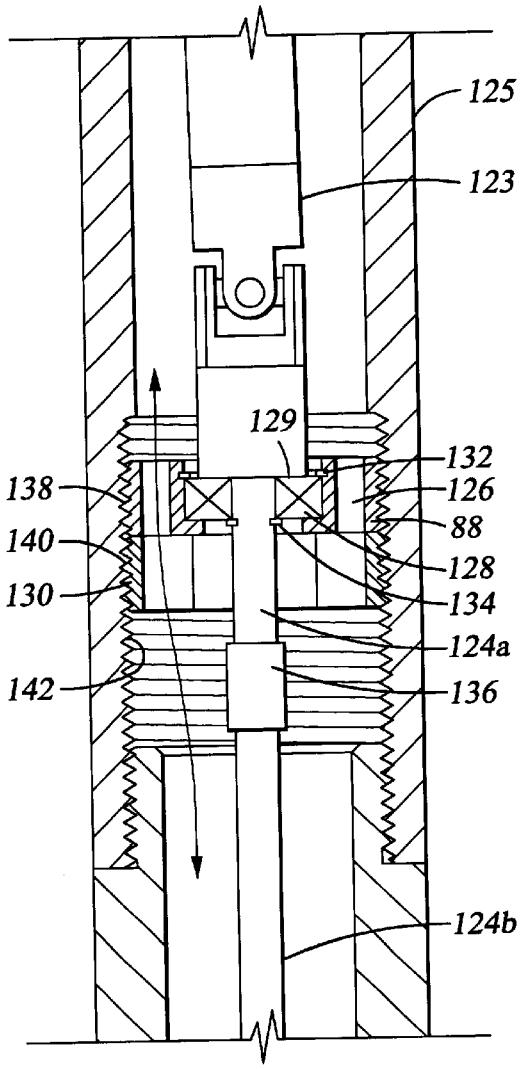
FIG. 39 is a schematic cross sectional detail of the embodiment shown in FIG. 38.

FIG. 38 is a schematic cross sectional view of one embodiment of an adjustable rotor for a PCP 20 when the PCP used as a motor, shown in FIG. 37. FIG. 39 is a detail of the embodiment shown in FIG. 38 and will be described jointly with FIG. 38. A wellbore 50 includes a tubular member 56 disposed therein. The PCP 20 is coupled to the tubular member 56 directly or indirectly through intermediate components. A rotor 26 is disposed within a stator 22, which can include an elastomeric member 24. The rotor and/or stator can be tapered, as has been described in the reference to FIGS. 5–26. A housing is coupled to the PCP 20 and encloses a series of components described below, such as shafts, universal joints and an adjustor. The rotor 26 is coupled to universal joints 121 and 123 with an intermediate shaft 122 disposed therebetween. A drive shaft 124*a* is coupled to the universal joint 123 and can be formed integrally therewith. A drive shaft 124*b* can be coupled to the drive shaft 124*a* with a coupling 136 and provides an output drive for tools attached thereto. An adjustor 88 can be mounted within the PCP 20 or in an adjacent member to the PCP, such as the housing 125. The adjustor can threadably engage the housing with threads 138 formed on the adjustor to correspond to threads 140 formed on the housing. The shaft 124*a* can be disposed within the adjustor 88, so that the adjustor 88 can longitudinally move the shaft 124*a*, i.e., in an up and down direction in the figure, and components attached thereto to adjust the relative position of the rotor 26 with the stator 22. Because fluid is generally used to actuate the PCP 20 as a motor, one or more ports 126 can be formed in the adjustor 88 through which the fluid can flow. A bearing 128 can be disposed between a supporting surface 129, for example, formed adjacent the shaft 124*a*, and the adjustor 88 to reduce friction as the rotor 26 and shaft 124*a* rotate. A fastening member 130 can be coupled to the housing 125, for example, with threads 142, for holding the adjustor 88 in position. A retainer 132, such as a snap ring, can be disposed above the bearing 128 to hold the bearing in position with the adjustor 88. A retainer 134 can be disposed below the bearing 128 to hold the universal joint 123 and/or shaft 124*a* in position with the bearing 128.

In operation, fluid is flowed down the tubular member 56 to the PCP 20, through the interface between the rotor 26 and the stator 22, out the PCP 20 and through the port(s) 126. The rotor 26 can be adjusted relative to the stator 22 by rotating the adjustor 88 from a first position to a second position within the housing 125 and fastening the adjustor 88 in that longitudinal position with the fastening member 130. In the embodiment shown in FIGS. 35 and 36, generally, the motor would be pulled to the surface to make the adjustments described.

While foregoing is directed to the preferred embodiment of the present invention, other and further embodiments of the invention may be devised without departing from the basic scope thereof, and the scope thereof is determined by the claims that follow.

I claim:

1. A progressive cavity pump having an inlet and an outlet, comprising:

a) a stator having a helical internal bore with at least two helical threads, the stator being tapered at least partially between the inlet and the outlet;

b) a rotor having a helical periphery with one helical thread less than the stator and disposed at least partially within the stator to form a plurality of cavities between the rotor and the stator, the rotor being tapered at least partially between the inlet and the outlet;

c) an adjustor coupled to the rotor that allows manual adjustment of the rotor relative to the stator; and d) a shaft extending from a wellbore surface coupled to the rotor and coupled to the adjustor.

2. The pump of claim 1, wherein the adjustor comprises a threaded coupling.

3. The pump of claim 2, further comprising a controller coupled to the sensor and the adjustor.

4. The pump of claim 1, further comprising a sensor coupled to the shaft.

5. The pump of claim 4, whereby the controller changes a longitudinal position of the rotor relative to the stator with the adjustor dependent on sensor input of speed.

6. A progressive cavity pump having an inlet and an outlet, comprising:

a) a stator having a helical internal bore with at least two helical threads, the stator being tapered at least partially between the inlet and the outlet;

b) a rotor having a helical periphery with one helical thread less than the stator and disposed at least partially within the stator to form a plurality of cavities between the rotor and the stator, the rotor being tapered at least partially between the inlet and the outlet; a shaft coupled to the rotor c) an adjustor coupled to the rotor that allows manual movement of the rotor relative to the stator, wherein the adjustor comprises a threaded coupling and a sensor coupled to the shaft.

7. The pump of claim 6, wherein the stator and rotor are tapered in thread height.

8. The pump of claim 6, wherein the adjustor adjusts a fit between the rotor and the stator for a variable torque on the rotor.

9. The pump of claim 6, wherein the stator and rotor are tapered diametrically.

10. The pump of claim 9, wherein the stator and rotor are tapered in thread height.

11. The pump of claim 6, further comprising a controller coupled to the sensor and the adjustor.

12. The pump of claim 11, wherein the controller changes a longitudinal position of the rotor relative to the stator with the adjustor dependent on sensor input of speed.

13. The pump of claim 6, further comprising an adjustor coupled to the rotor, the adjustor comprising a first portion threadably engaged with a second portion, wherein rotation of the second portion within the first portion extends or retracts the second portion relative to the first portion.

14. The pump of claim 13, further comprising one or more stops coupled to the second portion.

15. A progressive cavity pump having an inlet and an outlet, comprising:

a) a stator having a helical internal bore with at least two helical threads, the stator being tapered at least partially between the inlet and the outlet;

b) a rotor having a helical periphery with one helical thread less than the stator and disposed at least partially within the stator to form a plurality of cavities between the rotor and the stator, the rotor being tapered at least partially between the inlet and the outlet; and c) an adjustor coupled to the stator that axially changes a relative position of the rotor with respect to the stator.

16. The pump of claim 15, wherein the stator and rotor are tapered in thread height.

17. The pump of claim 15, wherein the adjustor adjusts a fit between the rotor and the stator for a variable torque on the rotor.

18. The pump of claim 15, further comprising a sensor coupled to the shaft.

19. The pump of claim 15, wherein the stator and rotor are tapered diametrically.

20. The pump of claim 19, wherein the stator and rotor are tapered in thread height.

21. The pump of claim 15, wherein the adjustor comprises a threaded coupling.

22. The pump of claim 21, further comprising a controller coupled to the sensor and the adjustor.

23. The pump of claim 22, wherein the controller changes a longitudinal position of the rotor relative to the stator with the adjustor dependent on sensor input of speed.

24. The pump of claim 15, further comprising an adjustor coupled to the stator, the adjustor comprising a first portion threadably engaged with a second portion, wherein rotation of the second portion within the first portion extends or retracts the second portion relative to the first portion.

25. The pump of claim 24, further comprising one or more stops coupled to the second portion.

26. A method of adjusting a progressive cavity pump, comprising:

a) inserting a progressive cavity pump into a wellbore, the pump comprising:

i) a stator having a helical internal bore with at least two helical threads, the stator being tapered at least partially between the inlet and the outlet;

ii) a rotor having a helical periphery with one helical thread less than the stator and disposed at least partially within the stator to form a plurality of cavities between the rotor and the stator, the rotor being tapered at least partially between the inlet and the outlet;

b) positioning the rotor at a first longitudinal position relative to the stator; and c) adjusting the rotor to a second longitudinal position relative to the stator.

27. The method of claim 26, further comprising coupling a shaft to the rotor and adjusting the shaft longitudinally in the wellbore to adjust the rotor relative to the stator.

28. The method of claim 26, further comprising raising the rotor relative to the stator to decrease an amount of engagement between the rotor and the stator.

29. The method of claim 26, further comprising lowering the rotor relative to the stator to increase an amount of engagement between the rotor and the stator.

30. The method of claim 26, further comprising sensing an amount of engagement of the rotor relative to the stator and adjusting the longitudinal positions of the rotor relative to the stator dependent on the amount of engagement.

31. The method of claim 30, further comprising adjusting the longitudinal positions automatically based on input from a sensor.

32. The method of claim 30, wherein sensing the amount of engagement comprises sensing an amount of torque on the rotor.

33. The method of claim 32, further comprising adjusting the engagement based on the amount of torque.

* * * * *